United States Patent [19]

Knott

[11] 4,212,468

[45] Jul. 15, 1980

[54] PRESSURE SENSITIVE GAME APPARATUS

[76] Inventor: Philip H. Knott, One San Antonio Pl., San Francisco, Calif. 94133

[21] Appl. No.: 920,845

[22] Filed: Jun. 30, 1978

[51] Int. Cl.[2] ..... A63F 3/00

[52] U.S. Cl. ..... 273/240; 273/269; 35/66

[58] Field of Search ..... 273/269, 287; 35/61, 35/66

[56] References Cited

U.S. PATENT DOCUMENTS

| | | | |
|---|---|---|---|
| 1,568,548 | 1/1926 | Edelson | 35/66 |
| 2,596,890 | 5/1952 | Dechert | 35/61 |
| 3,063,164 | 11/1962 | Pellegrino et al. | 35/66 |
| 3,279,100 | 4/1964 | Knott | 35/61 |

OTHER PUBLICATIONS

*Erasable Thermal Writing for Displays,* p. 1862, IBM Technical Disclosure Bulletin, vol. 15, No. 6, Nov. 1972.

*Primary Examiner*—Richard C. Pinkham
*Assistant Examiner*—R. Carl Moy
*Attorney, Agent, or Firm*—Limbach, Limbach & Sutton

[57] ABSTRACT

Game apparatus in which symbols provided in a predetermined pattern on a sheet are to be marked selectively includes a sheet of flexible translucent material having the symbol pattern overlying, and a substantially rigid backing member attached to the translucent sheet and being coated with a pigmented material and a pressure sensitive, releasable adhesive material at least in areas corresponding generally to the symbol pattern so that pressure on the translucent sheet will urge that sheet into contact with the adhesive material and cause the pigmentation to show through the translucent sheet.

14 Claims, 7 Drawing Figures

PRESSURE SENSITIVE GAME APPARATUS

BACKGROUND OF THE INVENTION

This invention relates to apparatus for playing a game, for example, bingo, in which various symbols in a pattern on a sheet are selectively marked during the game. More particularly, the invention relates to such apparatus in which the symbol-carrying structure may be unitary and may function without the necessity for any additional unconnected pieces of apparatus.

Conventionally, in games in which symbols on a sheet are to be selectively marked during the game, this function has been provided either by placing additional objects, such as button-like structures, atop the symbols to be marked, or by use of a marking instrument, such as a pencil, to mark the selected symbol. The former of these structures has suffered from the obvious disadvantage of the requirement of numerous separate button-like pieces to place above the symbols, which pieces are bulky to package and subject to loss over the life of the game apparatus. The latter of the conventional structures has suffered from the disadvantages of both requiring a marking instrument, which is also subject to loss, exhaustion or damage, and of causing defacement of the sheets bearing the symbols, thus requiring their replacement.

In recent years a structure known popularly as a "magic slate" has become popular for providing a renewable surface for drawing or writing. This device includes a transparent top sheet of clear plastic, an intermediate sheet of a translucent plastic material, and a backing member of rigid cardboard, coated with transparent wax-like substance over a dark background. Marks are made on this structure by pressing and moving a stylus against the transparent top sheet urging it against the translucent sheet and the translucent sheet against the waxy material. The portions of the translucent sheet are forced into firm contact with the waxy material so that the dark background behind the waxy material shows through the waxy material and the translucent and transparent sheets in those areas, thus providing a representation of the figure drawn or written onto the structure. When it is desired to renew the surface for additional use, the translucent sheet is simply lifted free of its contact with the waxy backing material, so that it then provides a fresh, unmarked, translucent surface for additional drawing or writing.

SUMMARY OF THE INVENTION

Basically, the game apparatus of this invention comprises a sheet of flexible, translucent material having an overlying pattern of symbols to be selectively marked, and a substantially rigid backing member attached to the translucent sheet and having at least portions thereof coated with a pigmented material and a pressure sensitive, releasable adhesive material in a pattern corresponding to the symbol pattern such that finger pressure applied to any selected symbol will urge the portion of the translucent sheet adjacent that symbol into releasable adhesion with the adhesive material on the backing member, with the pigmentation showing through the translucent sheet in the area adjacent the selected symbol, whereby the application of finger pressure during a game may mark the symbol.

With the foregoing in mind, it is an object of the present invention to provide game apparatus in which selected ones of a pattern of symbols are to be marked during a game, which apparatus provides for repeated marking and erasing of the surface. It is a further object of this invention to provide such apparatus in which the symbol-carrying structure may be unitary and in which no additional structure, other than a user's finger, is required for use of the apparatus. It is yet another object of this invention to provide for erasure of the user markings without the requirement of additional structure or apparatus.

These and additional objects of the invention will be apparent from a consideration of the following detailed description of various preferred embodiments thereof given in connection with the following drawings.

DESCRIPTION OF PREFERRED EMBODIMENTS

Figure 1:
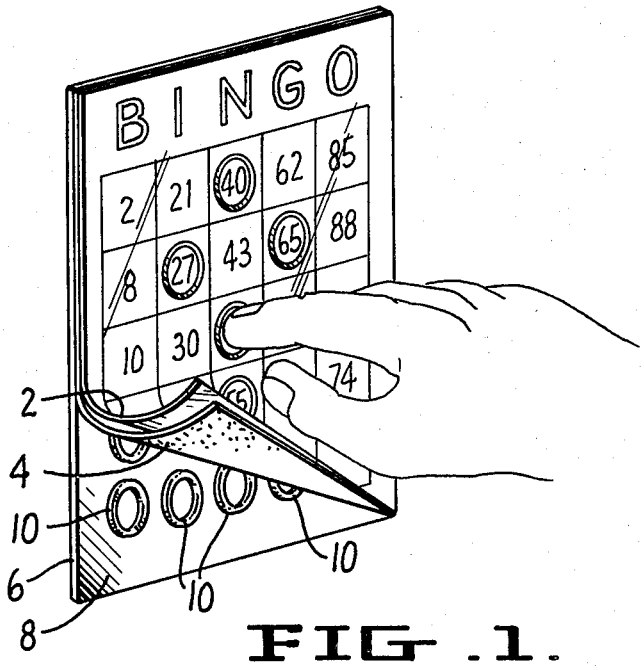
FIG. 1 is a perspective view of a particularly preferred embodiment of the present invention.
Figure 2:
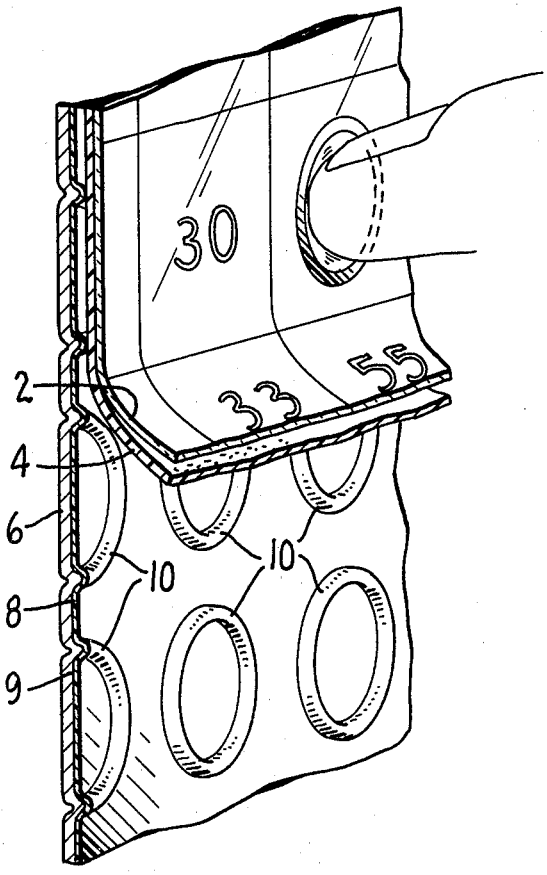
FIG. 2 is a fragmentary view, partially in section, of the apparatus of FIG. 1.

One particularly preferred embodiment of the game apparatus of this invention is illustrated in the perspective view of FIG. 1 and the fragmentary view of FIG. 2. In this and the other preferred embodiments, the apparatus of this invention is illustrated as structure for playing the popular game of bingo, although the structure obviously could be used for numerous other games in which symbols are provided in a predetermined pattern on a sheet and in which selected ones of those symbols are to be marked during the course of the game.

The basic components of the apparatus of FIGS. 1 and 2 include a top sheet 2 of transparent material, such as a flexible transparent plastic, attached to and overlying an intermediate sheet 4 of translucent material, such as a thin sheet of translucent plastic, which in turn is attached to and overlies a substantially rigid backing member 6, suitably of cardboard, plastic or other appropriate material. The thicknesses of sheets 2 and 4 are exaggerated for purposes of illustration, and their attachments to backing member 6 may be either permanent or releasable.

In the embodiment of FIG. 1, the transparent top sheet suitably may carry the symbol pattern imprinted thereupon. For the game of bingo this symbol pattern suitably will comprise the word "bingo" with five columns of five rows each of numbers, one such column arranged beneath the letters of the word "bingo". Obviously, for other games, other arrangements of the symbols could suitably be used. In this particularly preferred embodiment the symbols are shown printed upon the transparent top sheet 2, which sheet provides additional protection for the thin translucent sheet 4 immediately beneath it. However, if desired the symbol pattern could also overlie the translucent sheet in other manners, such as by printing upon that translucent sheet, with the transparent sheet being unprinted and the symbol pattern being viewable therethrough, of if desired, eliminated altogether, all such variations being within the scope of the invention.

The substantially rigid backing sheet 6 has at least portions thereof coated with a pressure sensitive, releasable adhesive material 8, suitably of the nature of the generally colorless waxy material commonly used on the backing member of the popular "magic slate" device, and a pigmented coating 9 underlying the adhesive coating 8. As an alternative, the pigmented coating and the adhesive coating could be combined into a single pigmented adhesive coating. While the embodiment of FIGS. 1 and 2 incorporates substantially continuous coatings of the adhesive material 8 and the pigmented material 9, such as ink, over the entire forward facing surface of backing member 6 which faces the translucent sheet 4, it is principally important that such coatings be provided at least in a pattern corresponding generally to the symbol pattern overlying the translucent sheet 4. In the embodiment of FIGS. 1 and 2 this desired pattern may be defined by a pattern of raised shapes 10 which may suitably be in the form of a plurality of rings embossed from the back side of the backing member 6 to project ahead of the front side of that member and toward the translucent sheet 4. While the shapes 10 are illustrated in FIGS. 1 and 2 as comprising circular rings, with one such ring generally centered on and underlying each of the number symbols provided in the pattern, obvious numerous other types of shapes could well be used. Such other shapes could include other hollow geometrical figures, solid raised and button-like configurations, or discontinuous figures and may be formed by numerous other methods, such as by molding the raised shapes or lands onto the forward facing surface of the backing member 6. Also, it is in no way necessary that the raised shapes 10 form a continuous geometrical figure, but suitably could be in the form of broken line figures, abstract patterns, solid raised buttons, or the like. An important feature of these shapes 10 is that they be provided in a pattern corresponding to the pattern of symbols overlying the translucent sheet, at least one such shape being positioned below and adjacent each of the symbols, preferably centered generally below each such symbol.

With the pattern of raised shapes 10 it also is important that the pressure sensitive adhesive 8 and the pigmented coating 9 cover at least those areas of the backing member defined by those raised shapes, for example, the rings 10 of FIGS. 1 and 2. Such application of the coating may suitably cover the entire forward facing surface of the backing member 6 of FIG. 2, or might conveniently be applied only to those raised shapes 10.

Figure 3:
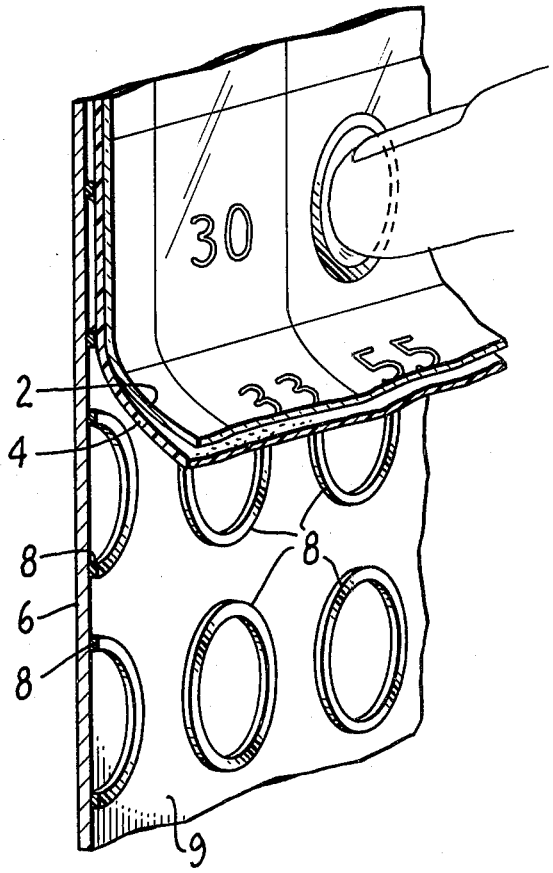
FIG. 3 is a fragmentary view, partially in section, of another embodiment of the apparatus of FIG. 1.

Alternately, the adhesive material 8 itself may be applied in the configuration of the desired raised shapes to an otherwise smooth and flat backing member 6, which is continuously coated with pigmented material 9, as illustrated in FIG. 3, or which may have the pigmentation underlying only the adhesive material shapes. With this configuration the raised application of the adhesive material 8 itself forms the raised shapes or lands formed by the embossing in the embodiment of FIG. 2.

With either of the embodiments of FIGS. 1 and 2 or FIG. 3 the apparatus may be used as follows. When a selected one of the symbols, such as one of the numbers appearing on the apparatus, is to be marked by a user, that user firmly presses his finger over or around that symbol. This pressure urges the top transparent sheet 2, if it is present, against the intermediate translucent sheet 4 and urges that translucent sheet 4 against the backing member 6. Since the backing member 6 has been provided with the raised shapes 10, one underlying each of the symbols, the pressure on the translucent sheet will tend to be greater against those raised shapes, which are in the pattern corresponding to the symbol pattern, that against the broad flat expanses of the backing member 6. The pressure, and thus adhesive, between the translucent sheet 4 and the adhesive 8 covering the raised shapes and the pigmented coating 9 will thus cause an image corresponding to the shape underlying the symbol to appear on the translucent sheet 4 as that sheet is pressed against the adhesive. This image formation will thus cause a mark to appear adjacent, through or around the selected symbol, depending upon the raised shape that is provided. If desired, a stylus or other pressure-imparting instrument could be used in place of the finger, although such additional equipment often will be unnecessary.

When it is desired to erase the marks appearing around the symbols, as in preparation for a new game, all that is required is to pull the translucent sheet 4 away from contact with the adhesive on the backing member and then let it lie freely against the backing member for use once again.

Figure 4:
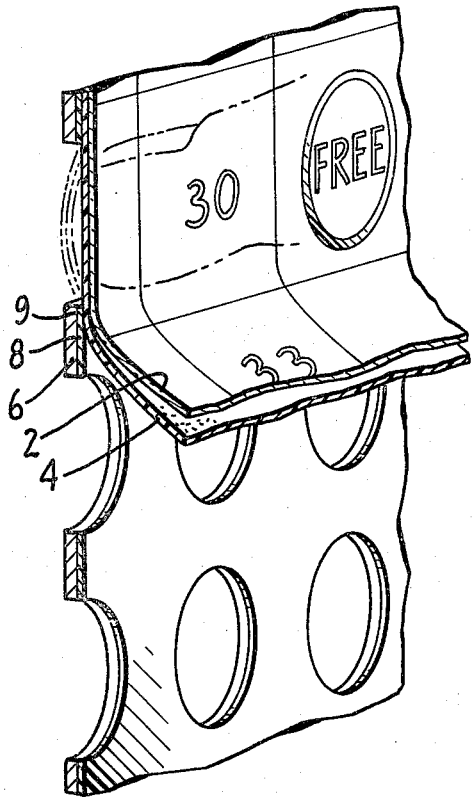
FIG. 4 is a fragmentary view, partially in section, of a third desirable embodiment of the apparatus of FIG. 1, incorporating a perforated backing member.
Figure 5:
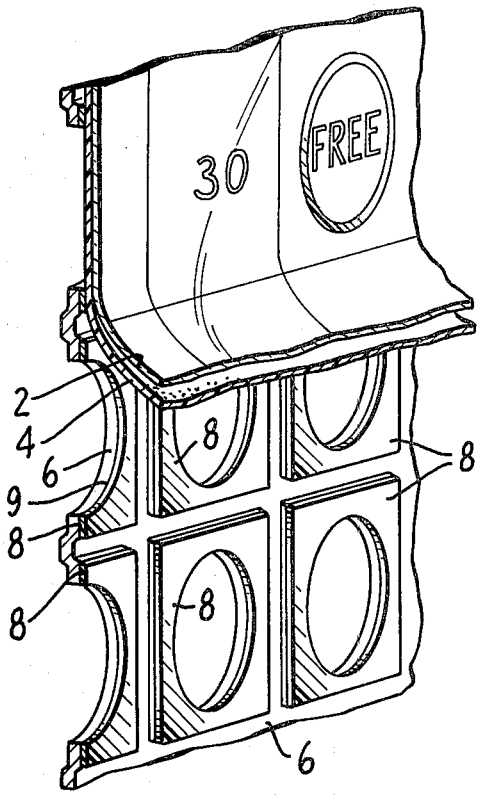
FIG. 5 is a fragmentary view, partially in section, of a variation of the apparatus of FIG. 4.

In FIGS. 4 and 5 are illustrated two additional embodiments of the apparatus of this invention. In both of these embodiments the backing member 6 is substantially planar with a pattern of geometrical shapes in the form of apertures through the backing sheet. The adhesive material 8 and pigmented coating 9 may suitably be applied either continuously over the entire face of the backing member 6 which faces the translucent sheet 4, as illustrated in FIG. 4, or only to those portions of that face which are immediately adjacent each aperture shape. Intermediate those two configurations is the configuration of FIG. 5, in which the adhesive material 8 and pigmented coating 9 extend a considerable distance out from each of the aperture shapes, but in which the portions of that backing member face which are spaced from the shapes (and thus from those portions underlying the symbol pattern) are substantially free from the adhesive material 8.

In the embodiments of FIGS. 4 and 5 finger pressure by a user upon one of the symbols overlying the translucent sheet 4 will serve to depress that sheet partially into the aperture of the shape underlying that symbol. Such pressure will also serve to urge the portions of the translucent sheet 4 which overlie the portions of the backing member 6 immediately surrounding that aperture into firm contact with those portions of te backing sheet. Since those areas of the backing member 6 are coated with the adhesive, this pressure will produce a mark on the translucent sheet, suitably centered upon the symbol, in the manner described with respect to FIGS. 1-3. The embodiment of FIG. 5, in which the adhesive discontinuously covers the backing member, has the additional advantage that pressure upon one symbol will tend to be more localized with less tendency of the pressure to be carried over to any adjacent symbol areas, which might cause an inadvertent marking of an adjacent symbol. The depression of the uncoated areas below the level of the coated areas, as illustrated, will further reduce any tendency toward inadvertent marking. As a variation upon the embodiments of FIGS. 4 and 5, the backing member could be continuous with the shapes being depressions extending away from the translucent sheet in place of the apertures of FIGS. 4 and 5 which extend completely through the backing sheet.

Figure 6:
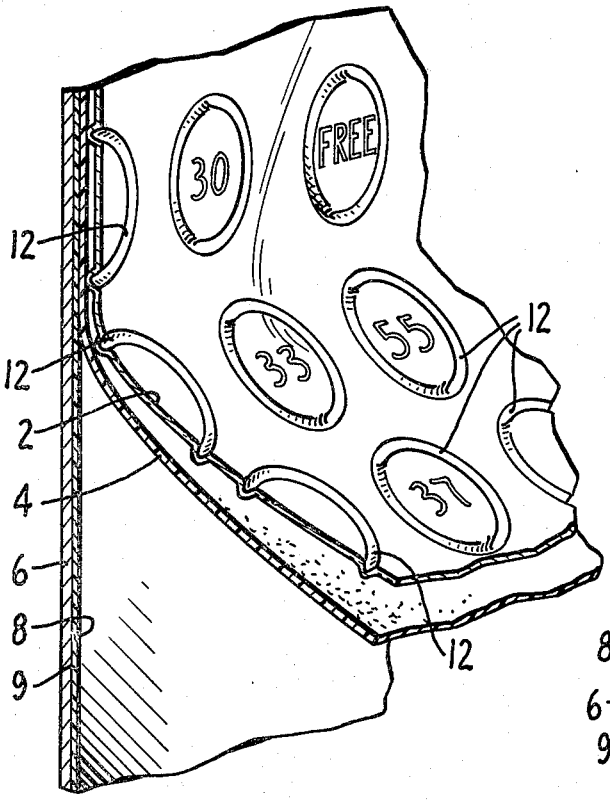
FIG. 6 is yet another desirable embodiment of the apparatus of FIG. 1, incorporating a patterned top sheet.

Another desirable embodiment of the apparatus of this invention is illustrated in FIG. 6, in which the backing member 6 is generally smooth and flat, and in which the translucent sheet 4 is as described in the preceding embodiment. The backing member 6 may be provided either with continuous coatings of adhesive 8 and pigmentation 9 entirely across its surface, as illustrated, or with localized areas of the coatings covering the portions adjacent those portions underlying the symbol pattern. In this embodiment the transparent top sheet 2 is provided with a pattern of shapes 12 projecting toward the translucent sheet with one of these shapes 12 at least partially surrounding each pattern symbol. In the illustration of FIG. 6 these projecting top sheet shapes 12 are suitably in the form of rings embossed into the top sheet, generally centered upon each respective symbol of the pattern, although any type of shape, continuous or discontinuous, could be used. Since the shape projects toward the translucent sheet 4, finger pressure upon the top sheet over a selected one of the pattern symbols will urge the surrounding top sheet projecting shape 12 against the translucent sheet, thus urging those portions of the translucent sheet against the backing member to form a mark in the general shape of that projecting top sheet shape 12. Thus, in the embodiment of FIG. 6 pressure upon the top sheet over one of the symbols will effect a ring-like mark around the selected symbol. The projecting shape in the top sheet could be formed by a variety of methods, including, without limitation, embossing, molding and other such processes. Additionally, it should be apparent that this formed top sheet could be used satisfactorily with others of the preceding embodiments, to further sharpen and define the mark to be made upon the translucent sheet.

Figure 7:
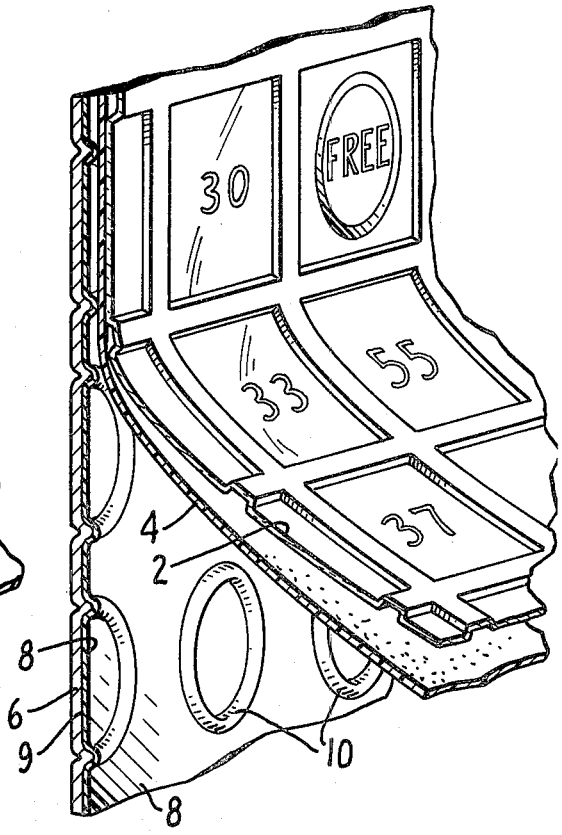
FIG. 7 is yet another desirable embodiment of the apparatus of FIG. 1 incorporating a patterned top sheet with the other structure of FIG. 1.

In FIG. 7 is illustrated a variation of the structure of FIGS. 1 and 2 in which the top sheet 2 includes portions, intermediate each symbol of the pattern, projecting away from the translucent sheet, in a waffle-like arrangement. This structure, which may be formed by a variety of methods such as molding, embossing and the like, serves to compartmentalize each portion of the top sheet 2 into areas corresponding to one of the symbols of the pattern. By this compartmentalization, during the application by a user of his finger to one of the symbols to form a mark, the finger will be restrained by the raised portions surrounding that "compartment" from slipping toward an adjacent symbol and possibly forming an unintended mark on such an adjacent symbol. Also, this raised pattern on the top sheet 2 will serve to localize the pressure above the selected symbol and reduce the tendency of pressure on the selected symbol causing marking of an adjacent symbol. Obviously this additional structure could be incorporated into any of the embodiments of FIGS. 1–5 to provide this benefit, and the transparent sheet 2 could be deleted with the waffle-like pattern being formed on the translucent sheet 4.

While the foregoing describes several preferred embodiments of the apparatus of this invention, it is apparent that numerous other variations and modifications, all within the scope of the invention, will readily occur to those skilled in the art. Such variations may include, among others, the provision of transparent and translucent sheets which are separably attached to the backing member, such as by clips, whereby different patterns of symbols may be used with the same translucent sheet and backing member. Since these and other variations are encompassed within the scope of this invention, the invention is to be limited not by the foregoing descriptions of preferred embodiments but solely by the claims appended hereto.

What is claimed is:

1. Game apparatus in which symbols are provided in a predetermined pattern and in which selected ones of those symbols are to be marked, comprising a sheet of flexible, translucent material having an overlying said symbol pattern, a substantially rigid and generally planar backing member attached to and behind said translucent sheet, said backing member having a fixed pattern of geometrical shapes extending below the surface of said backing member such that said translucent sheet may be depressed by a user partially into said pattern shapes, and said backing member having at least portions of the surface thereof which faces said translucent sheet coated with a pigmented material and a pressure sensitive, releasable adhesive material at least around portions of the periphery of each said geometrical shape, such that pressure applied upon the translucent sheet corresponding to a selected symbol of the symbol pattern will urge that portion of the translucent sheet partially into the corresponding backing member shape and into contact with the adhesive around the periphery of such shape to mark the selected symbol, and then the translucent sheet may be pulled free of such adhesion and marking for reuse in another game.

2. The game apparatus of claim 1 wherein said geometrical shapes are formed by apertures through said backing member.

3. The game apparatus of claim 1 wherein the portions of said backing member spaced from said portions underlying said symbol pattern are substantially free of said adhesive material, whereby pressure applied to a selected symbol will produce a mark only adjacent such symbol.

4. The game apparatus of claim 1 wherein the portions of said backing member spaced from the backing member portions adjacent said portions underlying said symbol pattern are depressed below the level of said adjacent portions, whereby any tendency of pressure on a selected symbol causing marking of any adjacent symbol will be reduced.

5. The game apparatus of claim 1 further comprising a top sheet of transparent material overlying said translucent sheet and said backing member.

6. The game apparatus of claim 5 wherein said symbol pattern is provided upon said transparent top sheet.

7. The game apparatus of claim 5 wherein said top sheet includes a pattern of fixed shapes projecting toward said translucent sheet with one said shape at least partially surrounding each said pattern symbol, whereby pressure upon the top sheet over a selected one of the pattern symbols will urge the surrounding top sheet projecting shape against the translucent sheet and backing member to form a mark in the general shape of that projecting shape.

8. The game apparatus of claim 5 wherein said top sheet includes portions intermediate each symbol of said pattern projecting away from said translucent sheet, whereby a pressure applied over a selected one of the symbols will be restrained from slipping toward an adjacent symbol and whereby any tendency of pressure on a selected symbol causing marking of an adjacent symbol is reduced.

9. Apparatus for playing bingo in which numbers are arranged on a playing surface in a pattern comprising columns and rows and in which selected ones of those numbers are to be marked, comprising a sheet of flexible, transparent material having said numbers viewable therethrough in said columns and rows;

a substantially rigid backing member attached to and underlying said transparent sheet and having a fixed pattern, corresponding to said number pattern, of geometrical shapes extending from the surface of said backing member, said backing member being coated with a pigmented material and a pressure sensitive, releasable adhesive material at least adjacent portions of the periphery of each said geometrical shape; and a sheet of flexible, translucent material interposed between said transparent sheet and said backing member, whereby pressure applied, as by the finger of a player or by other instrument, to one of the numbers viewable through the transparent sheet will urge a portion of the transparent sheet against the translucent sheet and a portion of the translucent sheet against the corresponding backing member geometrical shape and into contact with the adhesive material around the periphery of said geometrical shape and cause the pigmentation to show through the translucent sheet in that area to mark that number.

10. The bingo apparatus of claim 9 wherein said pressure sensitive, releasable adhesive material is generally colorless, whereby the marking occurs by the pigmented coating showing through the adhesive coating and the translucent sheet in the areas of adhesion.

11. The bingo apparatus of claim 9 wherein said backing member shape pattern comprises a pattern of raised shapes projecting toward said translucent sheet.

12. The bingo apparatus of claim 11 wherein said raised shapes comprise raised rings with one said ring being generally centered below each said number, whereby application of finger pressure upon each such number will cause a pigmented ring to appear upon the translucent sheet generally centered upon the such number to mark that number.

13. The game apparatus of claim 9 wherein said backing member shape pattern comprises a plurality of apertures through said backing sheet with one said aperture generally centered below each said number on said transparent sheet, whereby finger pressure upon a selected one of the numbers will urge the translucent sheet into the backing member aperture underlying that number and into contact with the adhesive material around portions of the periphery of that aperture to enable the pigmentation to show through on said translucent sheet.

14. The bingo apparatus of claim 9 wherein portions of said backing member intermediate the areas generally underlying said numbers are substantially free of said adhesive material, whereby pressure applied to a selected number will produce a mark only adjacent that number.

* * * * *